US006386597B1

(12) United States Patent
Walsh, III

(10) Patent No.: US 6,386,597 B1
(45) Date of Patent: May 14, 2002

(54) DUAL LATCH RETRACTION SYSTEM FOR EXIT BAR

(75) Inventor: John E. Walsh, III, Wallingford, CT (US)

(73) Assignee: Harrow Products, Inc., Grand Rapids, MI (US)

( * ) Notice: Subject to any disclaimer, the term of this patent is extended or adjusted under 35 U.S.C. 154(b) by 0 days.

(21) Appl. No.: 09/414,202

(22) Filed: Oct. 7, 1999

(51) Int. Cl.[7] ..... E05B 65/10
(52) U.S. Cl. ..... 292/92; 292/201; 70/92
(58) Field of Search ..... 292/92, 251.5, 292/201, 21; 70/92, 277

(56) References Cited

U.S. PATENT DOCUMENTS 3,614,145 A * 10/1971 Zawadzki ..... 292/92
3,854,163 A * 12/1974 Zawadzki ..... 292/92
4,801,163 A * 1/1989 Miller ..... 292/92
4,875,722 A * 10/1989 Miller ..... 292/92
4,976,476 A * 12/1990 Cross ..... 292/92
5,340,171 A * 8/1994 Slaybaugh ..... 292/21
5,823,582 A * 10/1998 Frolov ..... 292/92
6,104,594 A * 8/2000 Frolov ..... 361/152

* cited by examiner

*Primary Examiner*—Gary Estremsky
(74) *Attorney, Agent, or Firm*—Alix, Yale & Ristas, LLP

(57) ABSTRACT

An exit bar for securing a door has a housing assembly adapted for mounting to a door. A push pad for receiving a push force is mounted to the housing assembly. A latch is pivotable relative to the housing assembly to releasably latch the door to which the exit bar is mounted. A mechanical retraction system links the push bar to the latch so that a push force exerted on the push pad releases the latch. A selectively operable electromagnet is disposed within the housing assembly. An electromagnetic retraction system links the electromagnet to the latch independently of the mechanical retraction system so that selective operation of the electromagnet retracts the latch. The electromagnet further dogs the electromagnetic retraction system, and thereby the latch, in the retracted condition as long as the electromagnet receives power. The push bar and mechanical retraction system may be dogged by the electromagnet upon the first exertion of a push force thereon.

20 Claims, 8 Drawing Sheets

DUAL LATCH RETRACTION SYSTEM FOR EXIT BAR

BACKGROUND OF THE INVENTION

This invention relates to the field of door security systems. More specifically, this invention relates to the use of a push bar or exit bar for securing a doorway.

Push bars, also known as panic bars, which allow egress through a doorway while limiting ingress are well known components of door security and emergency systems. The conventional exit bar is mounted on the interior side of the door to be secured and is oriented generally horizontally across the interior face of the door. A manual push force on the bar toward the door face retracts a door latch bolt to permit opening of the door. Conventional exit bars typically employ a mechanical linkage to actuate the latch mechanism for unlatching the door. A handle can also be additionally provided on the exterior face of the door to allow ingress under certain circumstances. Exit bars have also been connected with alarm systems to warn security personnel of a door opening.

Conventional exit bar systems while enjoying great popularity have also exhibited a number of limitations. During periods of high traffic levels through a doorway, mechanical latch mechanisms of a conventional exit bar can experience a high rate of wear. To reduce wear on mechanical latch components, some conventional exit bars may be manually locked or "dogged", wherein the latches remain in a retracted state. However, each bar must be manually dogged and undogged at the site of the door, thus constant attention by building personnel is required. Further, manual dogging of door latches is not permitted on fire doors as the door must latch to prevent the spread of fire.

It is also known to employ exit bars in which the latch bolt can be retracted and dogged in a retracted state by an electrical signal. Electrical dogging of exit bar latches in a retracted state is allowed on fire doors. In some known exit bars of this type the electrical retraction system is interrelated with the mechanical retraction system. Thus, the electrical retraction system must be capable of actuating a mechanical retraction system. This requires an electrical retraction system having sufficient power to overcome the inertia associated with movement of the parts of the mechanical retraction system. Other known exit bars require complex motors and/or multiple electromagnet—armature assemblies and/or solenoids to achieve latch bolt retraction and dogging.

SUMMARY OF THE INVENTION

Briefly stated, the invention in a preferred form is an exit bar with dual, independent retraction systems. The exit bar is conventionally mounted to a face of a door. The door is pivotally mounted to one side of a door frame with the opposing side of the door frame fixedly mounting a strike. The exit bar includes a housing which is mounted to the door. A latch bolt extends from the end of the housing and cooperates with the strike for releasably latching the door to the frame. A manual latch retraction system includes a push pad defining an exposed push face for receiving a manual push force. A link system links the pad to the latch assembly for retracting the latch bolt when the pad is pushed. A separate electrical latch retraction system includes an electromagnet mounted within the housing and a power source for selectively supplying electrical power to the electromagnet. An armature has an attracted surface disposed oppositely a magnetic face of the electromagnet. The armature is pivotally mounted to an armature shroud at a position intermediate the ends of the armature. The shroud is pivotably mounted at one end to a shroud pivot. The shroud pivot is transversely displaceable within the housing and is biased away from the door face. The opposing end of the armature shroud is pivotally and slidingly engaged to the latch assembly. A biasing force biases one end of the armature away from the electromagnet, such that the attracted surface of the armature and the magnetic face of the electromagnet define a wedge shape gap. The electromagnet develops a strong magnetic field when supplied with electrical power. The strong magnetic field bridges at least a portion of the wedge shape gap imposing a magnetic force, which is greater than the armature biasing force, on the armature. Consequently, the armature is pulled toward and bonded with the electromagnet by the high magnetic force. Movement of the armature is transmitted through the armature shroud and electrical retraction system linkage to the latch assembly to thereby move the latch bolt to a retracted position withdrawn from the latch strike.

The manual and electrical retraction systems operate independently of one another. Thus, the push pad may be used to retract the latch bolt from the strike without actuating the electrical retraction linkage. Likewise, the electrical retraction system may be actuated without actuating the manual retraction linkage. Since the retraction systems are independent, the electromagnet is not required to overcome the inertia associated with moving parts of the manual retractor system. Thus an exit bar may incorporate a smaller electromagnet to retract the latch. Alternatively, the independent retraction systems allow a given electromagnet to successfully retract the latch against a greater pre-load exerted on a door, as compared to exit bars with interrelated retraction systems. Thus, the inventive exit bar has greater reserve strength than conventional systems to overcome adverse conditions, such as warped doors, wind load or other forces exerted on the door.

When electrical power is supplied to the electromagnet, the electrical retraction system will retract the latch bolt. Continued supply of electrical power to the electromagnet will maintain the latch bolt in the retracted position, holding the exit bar in a dogged state. Since the manual retraction system is independent of the electrical retraction system, the manual retraction system remains free to move in response to manually imposed forces. Ordinarily, this could lead to undesirable and unnecessary wear on components of the mechanical retraction system if they were continuously actuated while the exit bar is held in a dogged stated by the electrical retraction system. Accordingly, the mechanical retraction system preferably includes a dogging armature. When the exit bar is held in a dogged state by the electrical retraction system, the first manual displacement of the manual retraction system will engage and bond the dogging armature to the electromagnet, holding the mechanical retraction system in a dogged state wherein further movement and thereby wear is prevented.

An object of the invention is to provide a new and improved exit bar that may unlatch and dog in the unlatched position without requiring an outside mechanical force to retract the latch.

Another object of the invention is to provide an exit bar having an electromagnetic latch retractor which functions independently of a mechanical push pad.

A further object of the invention is to provide an exit bar in which a single electromagnet operates an electrical retraction system, dogs the electrical retraction system and dogs a mechanical retraction system.

Still another object of the invention is to provide an exit bar with manual and electric latch retractors, the exit bar further including a simple and effective mechanism for holding both retractors in a dogged state.

BRIEF DESCRIPTION OF THE DRAWINGS

Other objects and advantages of the invention will be evident to one of ordinary skill in the art from the following detailed description, made with reference that the accompanying drawings in which.

DETAILED DESCRIPTION OF A PREFERRED EMBODIMENT

Figure 1:
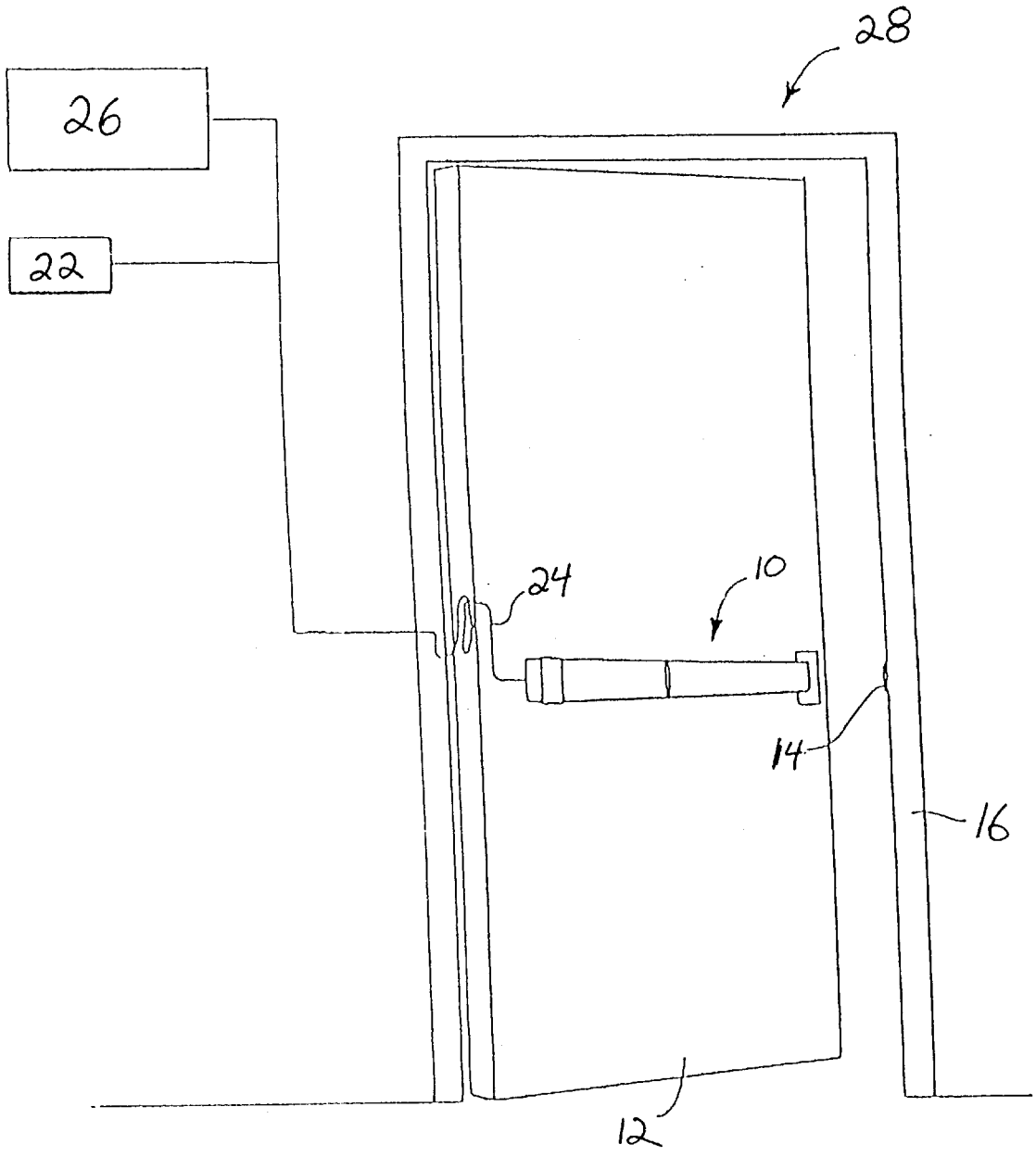
FIG. 1 is a schematic view of an exit bar mounted to a door having dual latch retractors in accordance with the invention and illustrating various auxiliary features thereof.

With reference to the drawings, wherein like numerals represent like components or structures throughout the Figures, a dual retractor exit bar of the invention is generally represented by the numeral 10. The exit bar 10 is mounted in a horizontal position across the interior side of a door 12 to be secured (FIG. 1). The exit bar 10 latches against a strike 14 mounted to the door frame 16 from which the door 12 is supported. A push force applied at the front of the exit bar 10 retracts the latch bolt 42 from the strike 14 and releases the door 12 to open for egress. Power is supplied to the exit bar 10 from a remote power source 22 over lines 24 in a conventional manner.

The exit bars of the invention are readily adaptable for communication with a remote control or security system 26. The remote security system 26 can be used to issue commands to the exit bar 10 to remotely unlatch the door and also to maintain the door in an unlatched state.

With reference to FIGS. 2 through 5, the exit bar 10 has an elongated main housing 32 which provides the principal mounting and support structure. The length of the housing 32 is preferably sufficiently long to substantially span the width of the door 12. The main housing 32 is mounted to the door 12 by screws or other fasteners (not shown) which secure the back panel 34 of the housing 32 in surface to surface disposition to the interior (secured) face of the door 12. The main housing 32 is channel-shaped with an elongated opening of the channel being spaced away from the door 12. A transversely displaceable push bar or pad 36 is located in the channel opening. The push pad 36 defines a push face for receiving a push force exerted toward the door 12 by a person attempting to egress through the door 12. The push pad 36 longitudinally spans a substantial portion of the housing 32.

Fixed inside the main housing 32 is a main lock frame 40. The main frame 40 is also generally channel-shaped to define an opening which is also spaced away from the door 12. The main frame 40 is fixed to the back panel 34 of the housing 32 by screws or other mounting hardware (not shown). For purposes of describing the invention as viewed in FIGS. 3, 4 and 5 the housing 32 defines a central longitudinal axis which extends parallel to the back panel and a transverse axis which extends perpendicularly from the panel surface.

The exit bar 10 secures the door 12 by use of a latch assembly 18. The latch assembly 18 may encompass a variety of forms. A latch assembly as described in U.S. Pat. No. 6,032,985 filed May 22, 1998, has been found suitable for use in the inventive exit bar 10, and that application is incorporated by reference herein. The latch assembly 18 includes a retractable or releasable latch bolt 42 which is pivotally mounted in the latch housing 20. The latch bolt 42 is held in a normally extended or latched position by a latch spring (not shown). The latch spring urges the latch bolt 42 to a first position against strike 14 mounted to door frame 16. A latch cover (not shown) surrounds the latch housing 20 to keep contaminants from the latch. When push pad 36 is transversely pushed into the housing 32 by a person attempting to egress, a pair of parallel push pad rails 44 mounted to the push pad 36 is moved transversely toward the door 12. The movement of the push pad rails 44 is coupled to a pivotally mounted lift link lever 46 of the latch assembly 18. The push pad rails 44 pivot lift link lever 46 which contacts latch bolt 42 to pivot latch bolt to a second released or unlatched position whereby the door 12 may be opened.

Figure 2:
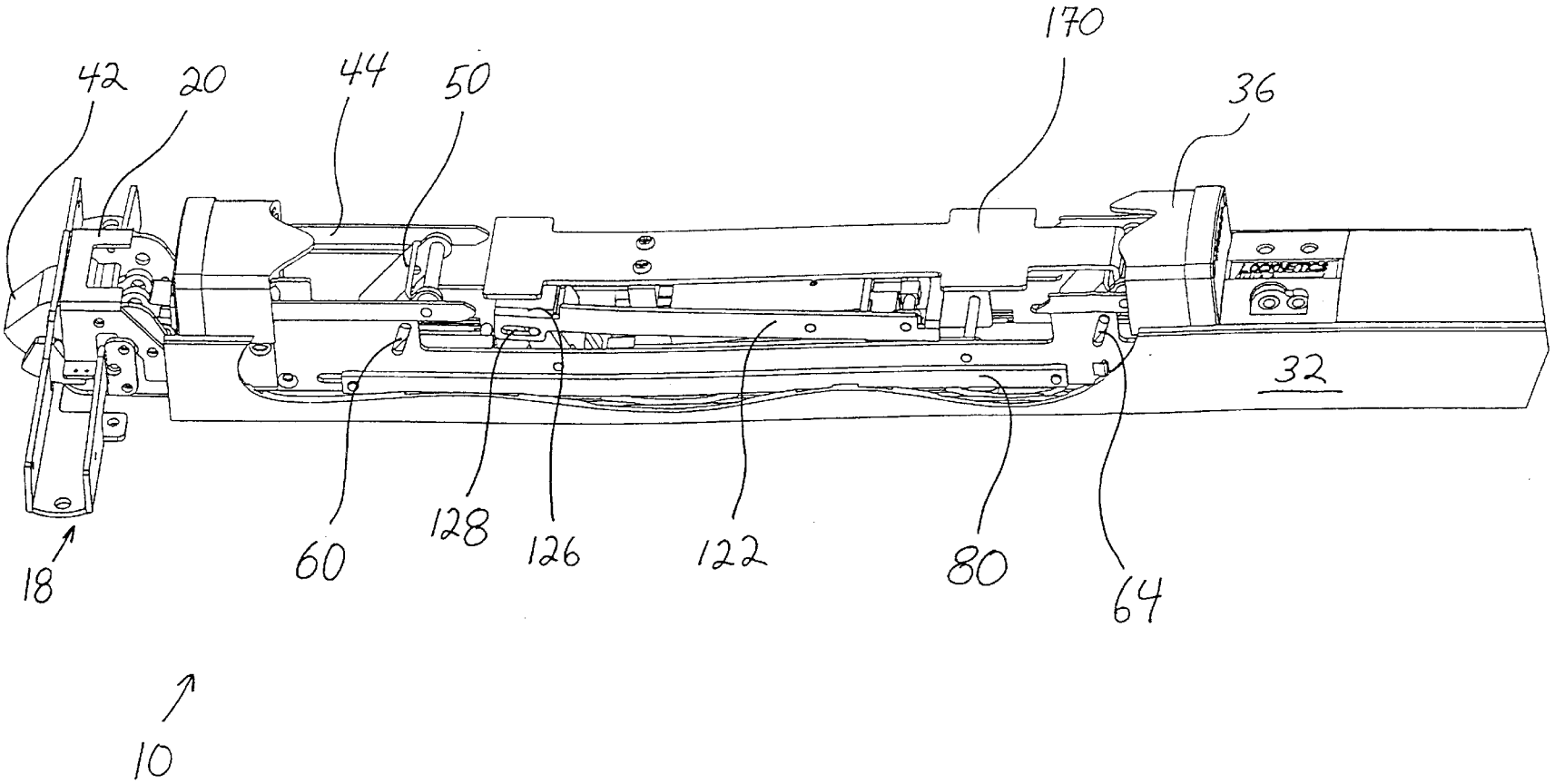
FIG. 2 is an enlarged perspective view of the inventive exit bar of FIG. 1 with portions of the housing and push pad removed.
Figure 3:
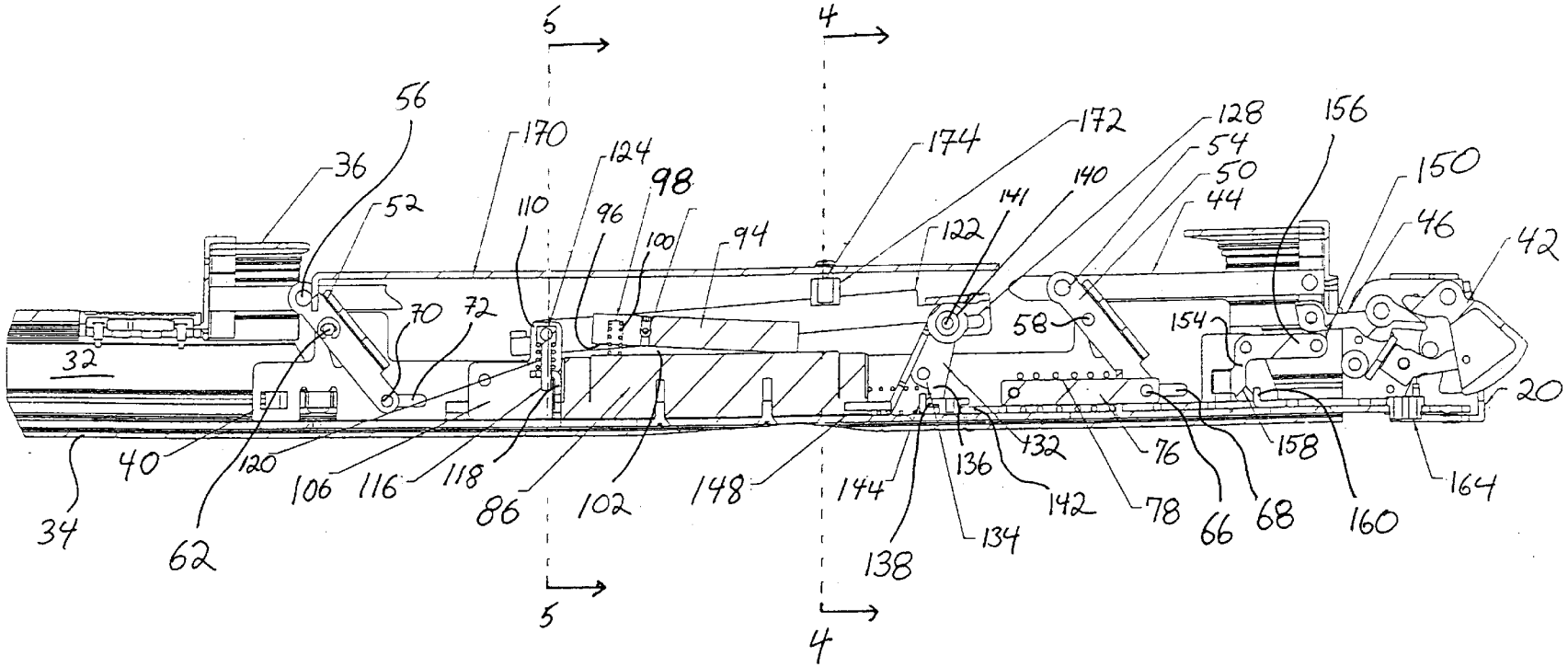
FIG. 3 is a longitudinal sectional view of the inventive exit bar of FIG. 1, viewed generally from the opposite side thereof, with portions of the housing and push pad removed, illustrating the latch bolt in the extended position.

As shown best in FIGS. 2 and 3, the push pad 36 is mounted to longitudinally extending rails 44 which are pivotally linked to the frame 40 for limited transverse movement therewith by a master main link 50 and a slave main link 52. The master main link 50 and slave main link 52 are pivotally connected to the rails 44 by pins 54, 56 respectively. A master main link pin 58 extends through the master main link 50 and slidably engages in master main link pin slots 60 formed by the frame 40. In a similar construction, a slave main link pin 62 extends through the slave main link 52 and slidably engages in slave main link pin slots 64 formed by the frame 40. The master main link slots 60 and slave main link slots 64 are generally perpendicular to the face of the door 12 upon installation of the exit bar 10.

As viewed in FIG. 3, master main link 50 extends from the rails 44 to almost the bottom of the channel of the frame 40. A second link pin 66 extends through master main link 50 and slidably engages into master main link lower slots 68 formed by frame 40. Slave main 52 link also extends to near the bottom of the channel of frame 40. A second slave main link pin 70 extends through the slave main link 52 and slidably engages in slave lower slots 72 formed by frame 40. The corresponding lower guide slots 68, 72 are oriented generally parallel to the face of the door 12 in the longitudinal direction. The master second link pin 66 also pivotally connects the master main link 50 to a first end of a main spring guide 76. Thus, the main spring guide 76 is longitudinally displaced as the second link pin 66 engages the master main link lower slots 68. A main spring 78 biases the main spring guide 76 away from the latch bolt or proximal end of the exit bar 10. An auxiliary rail 80 pivotally connects the master and slave main links 50, 52 at their second link pins 66, 70.

The construction of the master main link 50 and slave main link 52 with the associated actuation of pins and slots defines a transverse path for the rails 44 and push pad 36. Upon application of a push force, the transverse motion of the rails and push pad 36 is translated into generally longitudinal motion at the bottoms of the master main link 50 and slave main link 52 due to the orientation of the lower guide slots 68, 72. The provision of an auxiliary rail 80 linking the bottoms of the master and slave links 50, 52 ensures that a push force applied to either end of the push bar 36 will retract the latch bolt 42.

The links 50, 52, slots 60, 64, 68 and 72, rails 44 and lever 46 all act in concert as part of a manual retraction link system 82 to allow the push pad 36 to retract latch assembly 18. The push pad 36 is maintained in an extended position away from the door 12 and the links 50, 52 are maintained in an initial position by the bias of the main spring 78.

Figure 4:
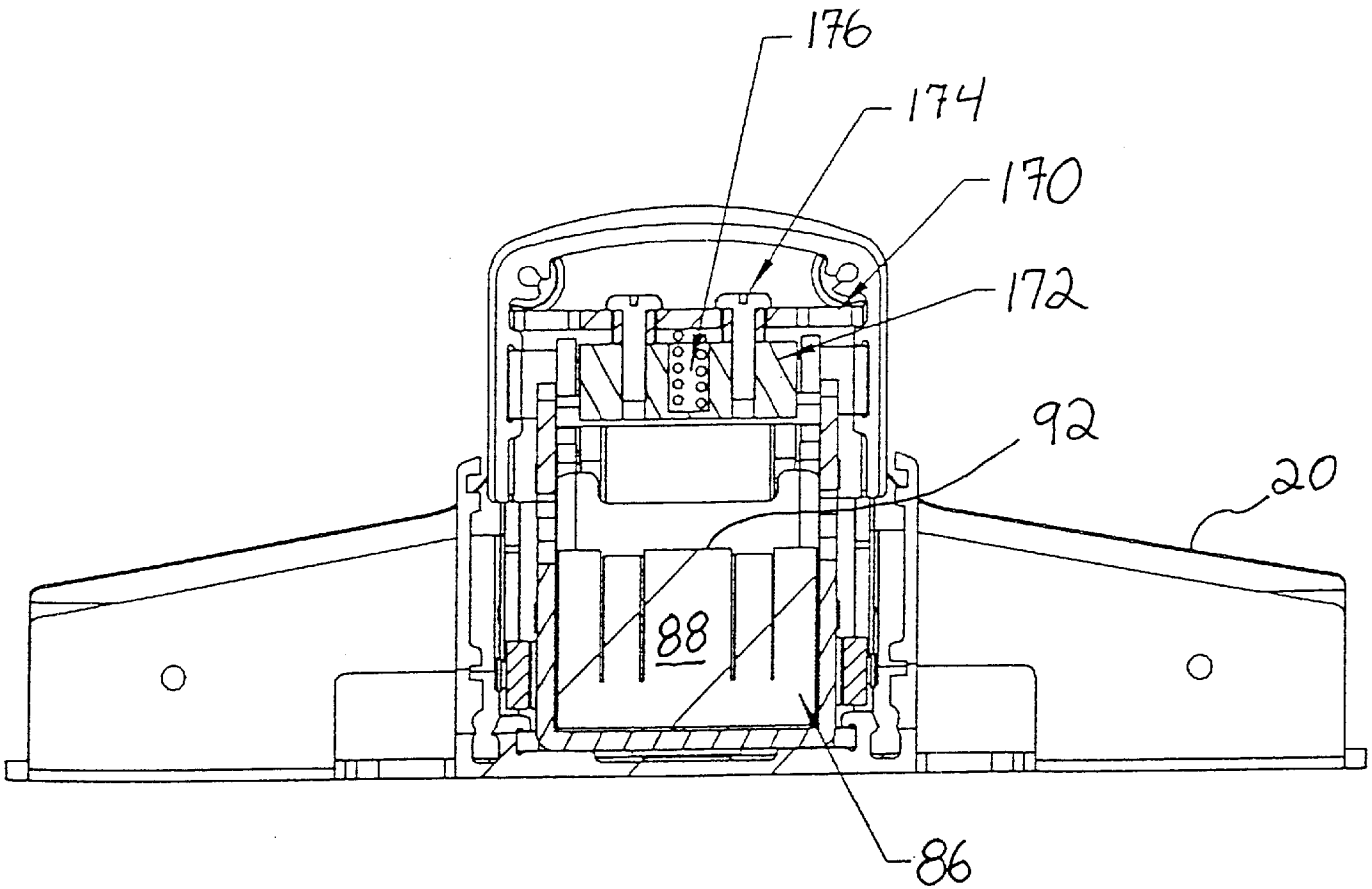
FIG. 4 is a transverse sectional view of the exit bar of FIG. 3 taken along the 4—4 thereof.
Figure 8:
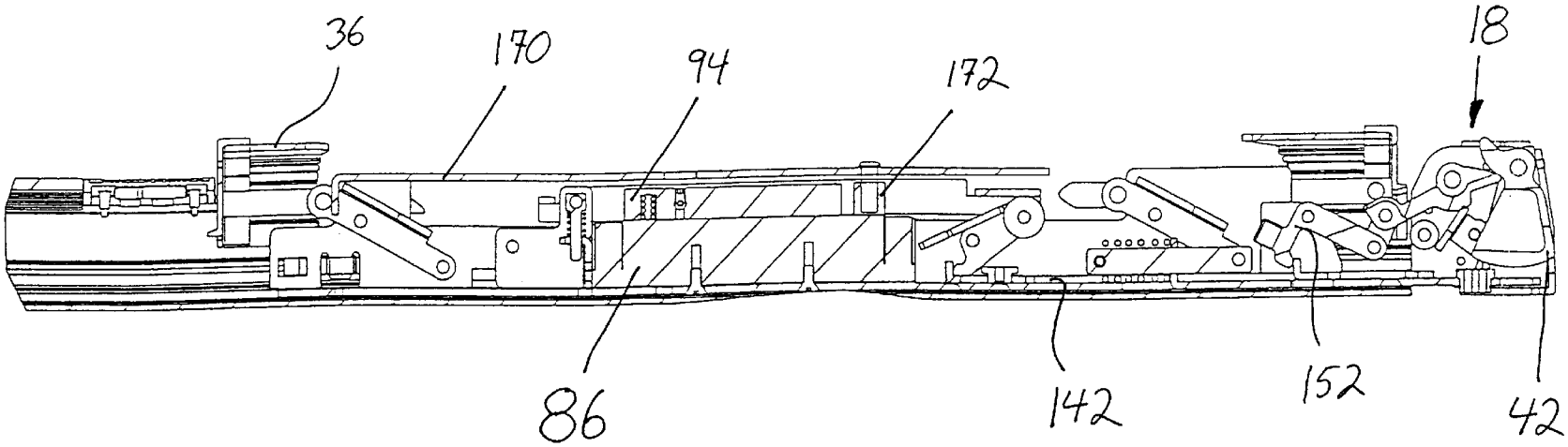
FIG. 8 is a view similar to FIG. 7 additionally showing the mechanical retraction system in the dogged state.

Within the exit bar 10, an elongated E-shaped electromagnet 86 is fixedly mounted to the frame 40 (FIG. 8). The electromagnet 86 is arranged longitudinally with the long axis of the electromagnet 86 parallel to the long axis of the housing 32 and frame 40. The electromagnet 86 is preferably constructed as shown in FIG. 4 of a series of stacked E-shaped plates 88 which act as poles of the electromagnet. An electromagnet coil (not shown) is preferably positioned in the slots defined by the stack of E-shaped plates 88. The rectangular ends of the legs of the stack of plates define an attractive magnetic face 92.

With reference to FIGS. 2, 3 and 4, the retraction armature 94 extends longitudinally within the frame opening from a proximal end closer to the latch assembly 18 to a distal end further from the latch assembly 18. The retraction armature 94 is preferably constructed of a ferromagnetic material which will provide a strong bond with the electromagnet 86 when the electromagnet 86 is energized. The armature 94 has an attracted face 96 which includes a blind bore 98 adjacent the distal end. A spring 100 is trapped within the blind bore 98 with an end of a spring 100 contacting the attractive face 92 to bias the end of the retraction armature 94 away from the electromagnet 86. When the electromagnet 86 is not energized, the armature 94, attracted face 96 and electromagnet attractive face 92 define a wedge shaped gap 102. When the electromagnet 86 is energized, the attracted and attractive faces 96, 92 are in substantially face-to-face contact. Thus, energizing of the electromagnet 86 pivotably draws the armature 94 transversely inward.

A bracket 106 is mounted to the frame 40 adjacent the distal end of the electromagnet 86. The bracket 106 includes two spaced plate portions 108 and is positioned within the frame 40 with a plate portion 108 adjacent each side of the channel. Each plate portion 108 includes a transversely outwardly extending lug 110 defining a slightly transversely elongated overtravel slot 112 therein. See FIG. 6.

Figure 5:
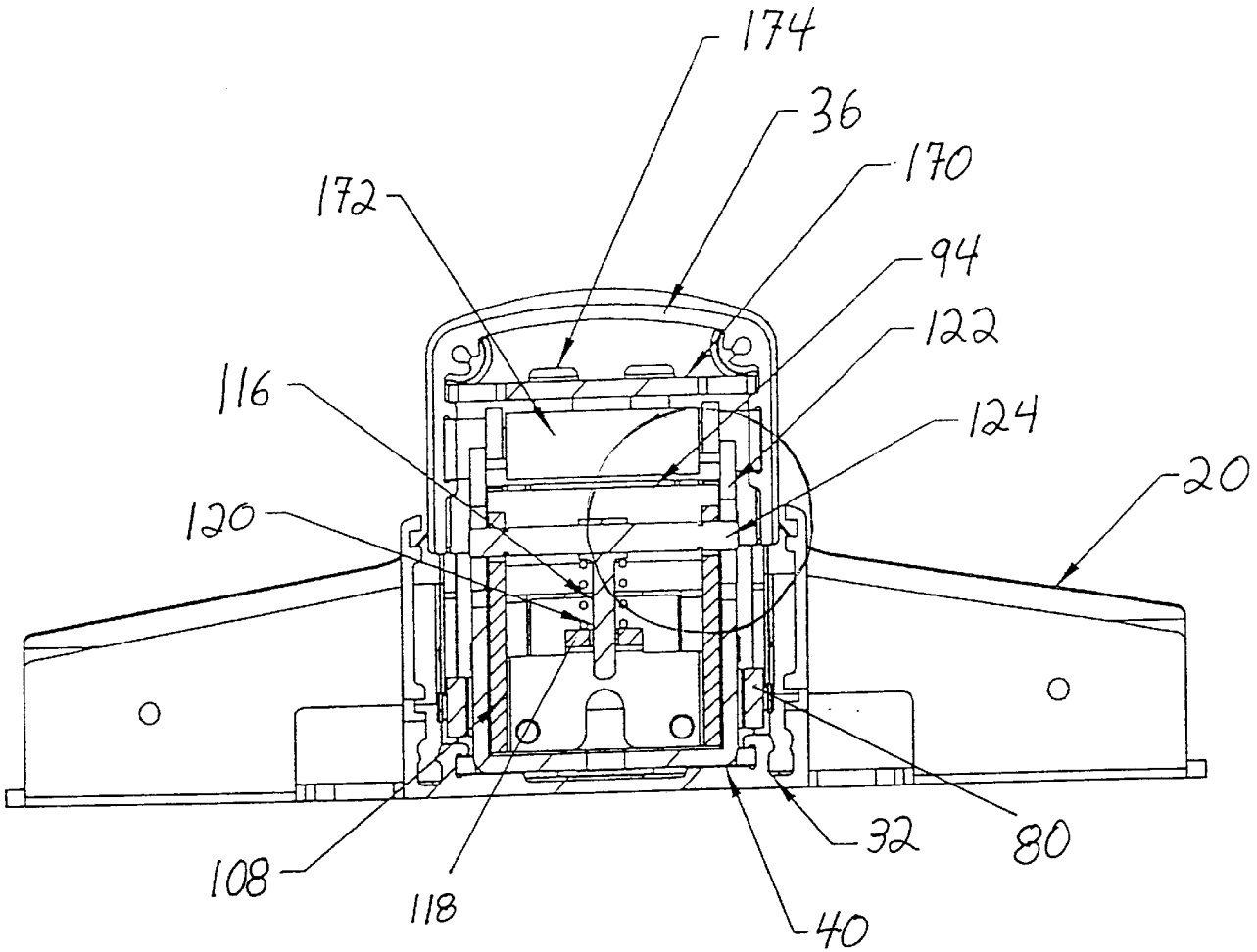
FIG. 5 is a transverse sectional view of the exit bar of FIG. 3 taken along thee 5—5 thereof.
Figure 6:
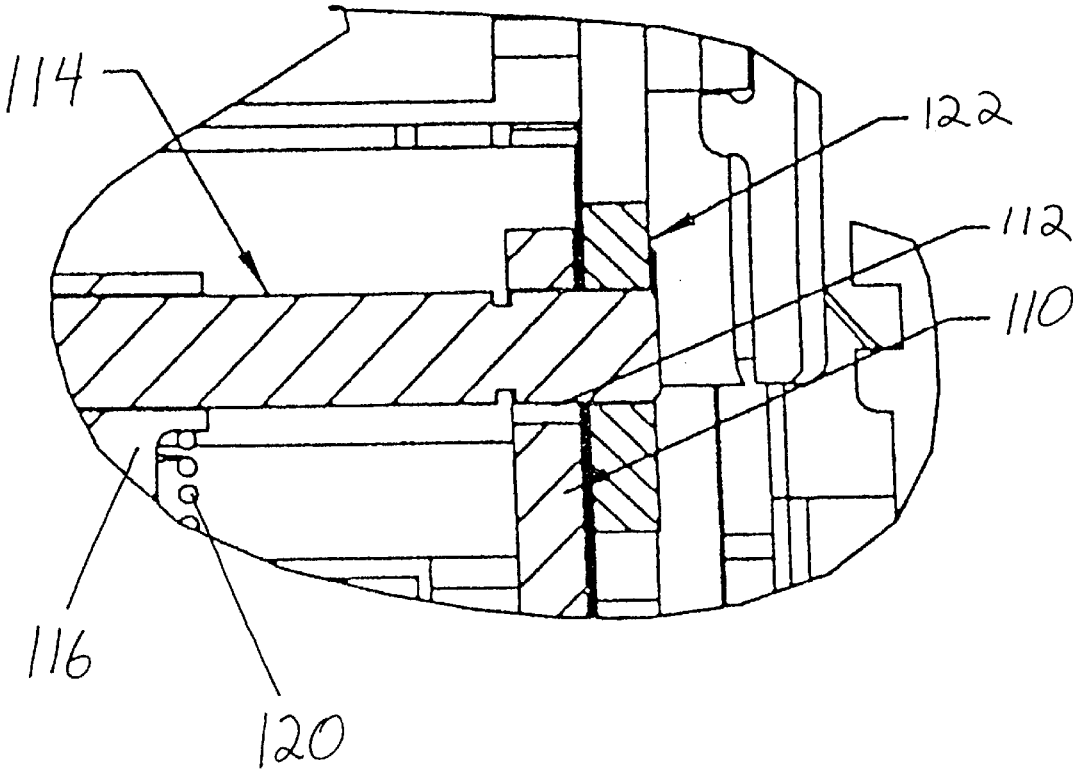
FIG. 6 is an enlarged detail view of a portion of FIG. 5.

As shown best in FIGS. 3, 5 and 6, an elongated, rectangular armature shroud 122 is positioned longitudinally within the push bar 36. The distal end of the armature 94 fits within the armature shroud 122. The armature 94 is pivotally connected between the blind bore 98 and the proximal end to the armature shroud 122 at a position between the armature shroud distal and proximal ends. The distal end of the armature shroud 122 fits between the mounting bracket transverse lugs 110 and is pivotally and transversely displaceably mounted to the lugs 110 by a pivot pin 114 extending into each of the overtravel slots 112. A T shaped biasing spring guide 116 is attached intermediate the ends of the pin 114 and is transversely guided by an L shaped yoke 118. A biasing spring 120 surrounds the leg of biasing spring guide 116 and is trapped between the head of the spring guide 116 and the yoke 118. The opposing proximal end of the armature shroud 122 terminates in a U-shaped section 126. The opening of the U-shaped section 126 faces transversely inwardly and each side arm of the U-shaped section 126 defines a longitudinally extending slot 128.

With reference again to FIG. 3, a pivot cam 132 extends substantially transversely from the armature shroud U-shaped section 126 to about the back panel 34 of the housing 32. The pivot cam 132 is pivotally mounted to the frame 40 intermediate the frame proximal and distal ends. A pin 134 pivotally couples the outward end of the pivot cam 132 to the longitudinal slots 128 within the armature shroud 122 to control movement of the armature shroud 122. Movement of the armature shroud 122 is transferred via contact of the shroud and roller 140 through roller pin 141 to pivot cam 132. The inward end 136 of the pivot cam 132 terminates in a rounded cam face 138.

An elongated trim slide 142 is disposed between the pivot cam inward end 136 and the housing back panel 34. The distal end of trim slide terminates in a transversely projecting first shoulder 144 engageable with the pivot cam rounded surface 138. The trim slide 142 parallels the housing back panel 34 terminating in a proximal end adjacent the latch assembly 18. The trim slide intermediate the distal and proximal ends defines a second shoulder 160 projecting transversely therefrom. Optionally, a longitudinally oriented spring 148 may be positioned between the proximal end of the electromagnet 86 and the distal end of the trim slide 142 to additionally bias the trim slide 142, and thereby the pivot cam rounded surface 138, toward the latch assembly 18. The trim slide 142 is longitudinally displaceable against the spring bias by interaction of the first shoulder 144 with the pivot cam rounded surface 138.

A trim pivot 152 has a transverse arm 154 extending transversely toward the trim slide 142. The trim pivot transverse arm 154 includes a rounded cam surface 158 for engagement with the trim slide second shoulder 160. A longitudinal arm 156 intersects the transverse arm 154 and extends substantially perpendicularly therefrom. The trim pivot 152 is pivotally mounted to the frame 40 at the intersection of the arms 154, 156. The trim pivot longitudinal arm 156 is operably connected by a connection link 150 to lift link lever 46 for actuation thereof to retract latch bolt 42.

The latch housing 20 may contain a rotatable trim cam 164 having two wings. Upon rotation in either direction the trim cam wings engage the proximal end of the trim slide 142 to displace the trim slide 142 away from the latch housing 20. The displacement of the trim slide 142 causes the second shoulder 160 to engage with the trim pivot rounded cam 158 thereby pivoting the trim pivot 152 and retracting the latch assembly 18. The trim cam 164 is operably connected to a lockable handle or knob (not shown) on the unsecured side of the door 12.

Figure 7:
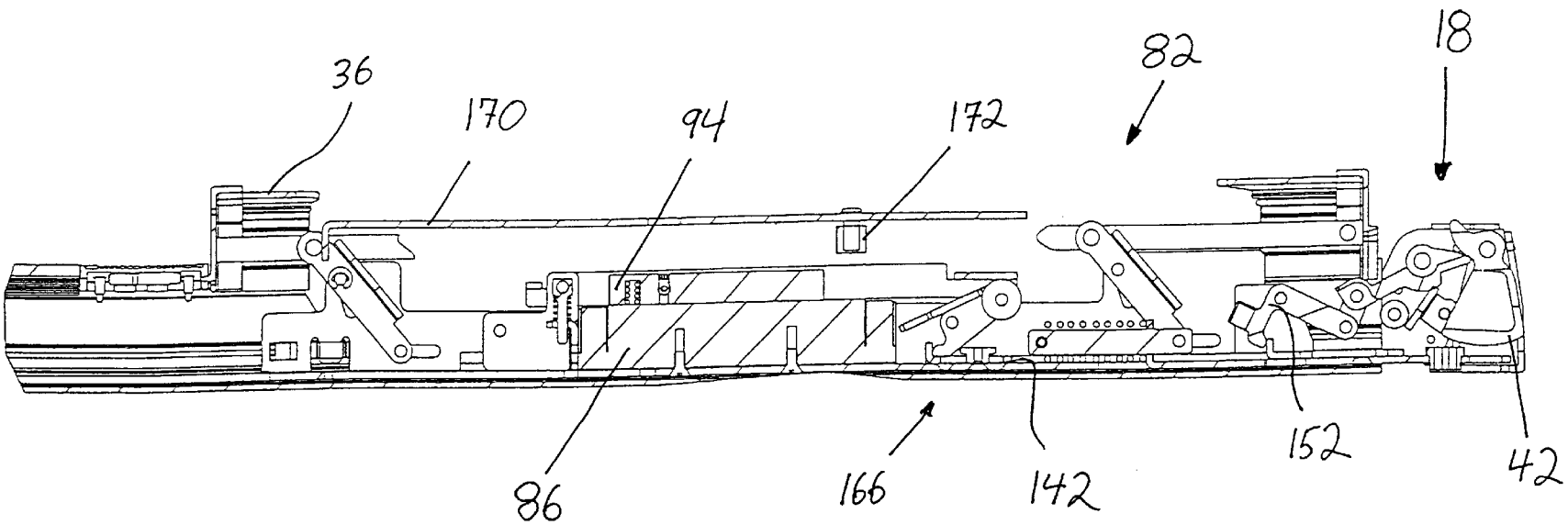
FIG. 7 is a view similar to FIG. 3 showing the electromagnetic retraction system in the dogged state and the latch electrically retracted.

The pivot mounting bracket 106, armature shroud 122, armature 94, electromagnet 86, pivot cam 132, trim slide and trim pivot 152 all act in concert as part of a electrical or electromagnetic retraction link system 166 to allow the electromagnet 86 to retract the latch assembly 18 as shown in FIG. 7.

As explained above, the distal end of the armature shroud 122 is mounted to the frame 40 (via mounting bracket 106 and pin 114) and the proximal end of the armature shroud 122 is mounted to the pivot cam 132. The proximal end of the armature 94 is adjacent the electromagnet attractive face 92, while a spring 100 within a blind bore 98 located in the distal end of the armature 94 biases the armature 94 away from the electromagnet 86. The armature 94 is pivotally connected between the blind bore 98 and the proximal end to the armature shroud 122. When no magnetic forces are applied to the armature 94, the biasing force of the spring 100 causes the armature 94 to separate from the attractive face 92 pushing the distal end of the armature 94 and thereby the pivotally connected armature shroud 122 proximal end away from the electromagnet 86. As a result, a wedge shaped gap 102 is formed between the armature 94 and the electromagnet 86, with the proximal end of the armature closely adjacent to or preferably in contact with the electromagnet attractive face 92 and the width of the gap increasing longitudinally toward the distal end of the electromagnet 86 as shown in FIG. 3.

When the electromagnet 86 is energized, the power provided by the power source 22 produces a magnetic force that in conjunction with the contact between the proximal end of the armature 94 and the electromagnet 86 and the narrow width of the gap 102 adjacent the proximal end of the armature 94 is sufficient to overcome the biasing force of the armature spring 100. The magnetic force causes the armature 94 distal end to pivot transversely inward to close the gap 102 until the attractive and attracted faces, 92 and 96, are in substantially face to face contact. The displaceable mounting of the shroud pivot pin 114 within the transversely elongated overtravel slots 112 in cooperation with the transversely outward bias exerted by the spring 120 allows any slight misalignment of the faces 92, 96 to be accommodated.

As the armature 94 closes the gap 102, the magnetic attraction increases, thereby accelerating the movement of the armature 94 toward the electromagnet 86. The transversely inwardly movement of the armature 94 is translated through the pivotal mounting of the armature 94 and armature shroud 122 to a transversely inward movement of the armature shroud 122 proximal end. This transversely inward movement is translated to a clockwise rotational (as viewed from the perspective of FIG. 3) movement of the pivot cam 132 around the pivot cam pin 134 and consequently clockwise rotational movement of the pivot cam inward end rounded surface 138. The rotational movement of the pivot cam 132 longitudinally displaces trim slide 142 via engagement of the trim slide shoulder 144 with the rounded cam surface 138. The longitudinal displacement of the trim slide 142 serves to pivotally move the trim pivot 152 in a clockwise fashion, thereby actuating the lift link lever 46 to retract the latch bolt 42.

It will be noted that actuation of the manual retraction system 82 retracts the latch assembly 18 without movement of the electromagnetic retraction system 166. Likewise, actuation of the electromagnetic retraction system 166 retracts the latch assembly 18 without movement of the manual retraction link system 82.

During periods of high traffic use, it may be advantageous to dog the exit bar 10 in an unlatched or released position. Dogging the retraction assemblies 82, 166 and thereby the latch assembly 18 reduces mechanism wear and tear, noise and speeds ingress and egress through the doorway. When the dogging feature is desired, electromagnet 86 is energized to attract the armature 94 thereby actuating the electromagnetic retraction system 166 and retracting the latch bolt 42. Continuous energizing of the electromagnet 86 maintains the latch assembly 18 in the retracted state through the electromagnetic retraction link system 166 as shown in FIG. 7. The dogging feature may be accomplished by a signal from the remote control system 24 over lines 22 and does not require application of a push force to the push pad 36.

When the electromagnetic retraction system 166 is in the dogged condition, the manual retraction system 82 remains free to move. Thus, the manual retraction system 82 remains susceptible to excess wear and tear. The push pad 36 may include a longitudinally extending suspension plate 170 mounted thereto. An auxiliary dogging armature 172 is displaceably mounted to the suspension plate 170 by fasteners such as bolts 174. A biasing spring 176 is captured between the auxiliary dogging armature 172 and the suspension plate 170 to bias the dogging armature transversely 172 inwardly. When the electromagnet 86 is energized, the magnetic force created is insufficient to attract the auxiliary dogging armature 172 to the electromagnet 86 for bonding thereto. However, the first application of a manual force displacing the push bar 36 transversely inwardly will cause the auxiliary dogging armature 172 to contact the electromagnet 86 thereby bonding the dogging armature 172 to the electromagnet 86 as long as the electromagnet remains energized. Thus, when the electromagnetic retraction system 166 is in the dogged condition, the first displacement of the push bar 36 will secure the mechanical retraction system 82 in a dogged condition as shown in FIG. 8, preventing excess wear and tear on both retraction systems.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An exit bar comprising:

a housing assembly including a latch face defining an opening and defining a longitudinal axis;

a push bar mounted for displacement relative to said housing assembly, said displacement being substantially orthogonal to said longitudinal axis;

a latch assembly including a latch bolt pivotally mounted to said housing assembly and projectable through said opening;

a spring for biasing said latch bolt toward an extended position;

first retraction means displaceable between an outward position and an inward position in response to a force applied to said push bar for actuating said latch assembly to retract said latch bolt to a retracted position upon displacement of said first retraction means to said inward position; and second retraction means responsive to an electrical current for actuating said latch assembly to retract said latch bolt to a retracted position, said second retraction means comprising an electromagnet mounted within said housing assembly with an attractive face parallel to said longitudinal axis;

wherein said first retraction means and said second retraction means actuate said latch assembly independently of one another.

2. The exit bar of claim 1, including a retraction armature with an attracted face angularly displaceable from said attractive face, said armature pivotally connected to said second retraction means.

3. The exit bar of claim 2, further including a dogging armature mounted to said first retraction means, said dogging armature having an attracted face cooperative with said electromagnet to maintain said first retraction means in said inward position after displacement thereto.

4. The exit bar of claim 3, wherein said retraction armature attracted face and said dogging armature attracted face are spatially separable in a direction orthogonal to said longitudinal axis when said first retraction means is in said outward position.

5. The exit bar of claim 2, wherein said second retraction means includes a trim slide with a first end operably connected to said retraction armature and a second end actuating said latch assembly, said trim slide slidingly displaceable to retract said latch bolt to said retracted position.

6. The exit bar of claim 5, comprising:

a rotatable trim cam with a pair of wings engageable against said trim slide for retracting said latch bolt upon application of a rotating force in either a clockwise or counterclockwise direction, wherein said trim slide is responsive to either said electrical current or said rotating force to retract said latch bolt to said retracted position.

7. An exit bar for selectively securing a door to a door frame having a strike, comprising:

a housing assembly with a longitudinal axis mounted to a secure side of said door;

a latch assembly comprising:

a latch bolt pivotally mounted to said housing assembly and projectable to an extended position within said strike, a lift link with a first end cammingly engaging said latch bolt and a second end substantially parallel to said door side, said lift link pivotally mounted to said housing assembly intermediate said first and second ends;

a manual retraction assembly engageable with said lift link to push said second end toward said door and thereby pivot said latch bolt to a retracted position withdrawn from said strike;

an electromagnetic retraction assembly engageable with said lift link to pull said second end toward said door and thereby pivot said latch bolt to said retracted position, wherein said manual retraction assembly and said electromagnetic retraction assembly engage said lift link second end independently of each other.

8. The exit bar of claim 7, comprising:

a selectively operable electromagnet mounted within said housing assembly with an attractive face parallel to said door side; and a retraction armature with an attracted face, a first end of said attracted face adjacent said electromagnet and a second end of said attracted face biased away from said electromagnet, wherein the attractive face and attracted face define a generally wedge shaped gap, said retraction armature pivotally connected to said electromagnetic retraction assembly intermediate said retraction armature first and second ends.

9. The exit bar of claim 8, wherein a remote control system selectively operates said electromagnet.

10. The exit bar of claim 8, wherein said electromagnetic retraction assembly includes an elongated armature shroud and a shroud pivot, said shroud pivot displaceably mounted to said housing for movement transverse to said longitudinal axis and being biased away from said attractive face, and said armature shroud is oriented along said longitudinal axis and has a first end pivotally connected to said shroud pivot and a second end pivotally and slidingly engaged with a pivot cam; said retraction armature pivotally connected to said armature shroud intermediate said shroud first and second ends.

11. The exit bar of claim 8, wherein said manual retraction assembly includes a dogging armature for electromagnetic bonding with said electromagnet.

12. The exit bar of claim 11 wherein said manual retraction assembly dogging armature is positioned intermediate said retraction armature and said lift link second end.

13. The exit bar of claim 7, wherein said electromagnetic retraction assembly includes:

a pivot cam pivotally mounted to said housing assembly for movement along said longitudinal axis;

an elongated trim slide with a first end including a shoulder orthogonal to said longitudinal axis and an opposing second end, said pivot cam pivotally engageable with said shoulder, said trim slide slidingly displaceable along said longitudinal axis; and a trim pivot with substantially perpendicular first and second arms, said first arm engaging said trim slide second end and said second arm pivotally connected to said lift link, said trim pivot pivotally mounted to said housing assembly at the intersection of said trim pivot arms.

14. A door security system comprising;

a door frame having a door pivotally mounted to one side and a strike fixedly mounted to an opposing side;

an exit bar mounted to a secure face of said door, said exit bar comprising;

a housing with a longitudinal axis;

a latch assembly, said latch assembly including a latch bolt pivotally mounted relative to said housing and projectable to an extended position within said strike, a manual retraction assembly displaceable between an outward position away from said door face and an inward position closer to said door face, said manual retraction assembly actuateable to pivot said latch bolt to a retracted position withdrawn from said strike, and an electrical retraction assembly actuateable to pivot said latch bolt to said retracted position said electrical retraction assembly comprising a retraction_ armature with an attracted face and an electromagnet fixedly mounted relative to said housing with an attractive face parallel to said door face, wherein said manual retraction assembly and said electrical retraction assembly engage said latch assembly independently of each other; a power source operably connected to said exit bar; and a remote control system operably connected to said exit bar.

15. The door security system of claim 14, wherein;

said electromagnet is selectively operable by said remote control system for bistable operation between an energized state, wherein said latch bolt is retracted and an non-energized stated wherein said latch bolt is extended; and a first end of said attracted face adjacent said electromagnet and a second end of said attracted face biased away from said electromagnet, wherein the attractive face and attracted face define a generally wedge shaped gap in said non-energized state and are in substantially face-to-face contact in said energized state, said retraction armature pivotally connected to said electrical retraction assembly intermediate said retraction armature first and second ends.

16. The door security system of claim 15, wherein said manual retraction assembly includes a dogging armature electromagnetically bondable with said electromagnet in said energized state to retain said manual retraction assembly at said inward position after manual displacement thereto.

17. The door security system of claim 15, wherein said electrical retraction assembly includes an elongated armature shroud and a shroud pivot, said shroud pivot displaceably mounted to said housing for movement transverse to said housing longitudinal axis and being biased away from said attractive face, and said armature shroud oriented along said housing longitudinal axis and having a first end pivotally connected to said shroud pivot and a second end pivotally and slidingly engaged with a pivot cam pivotally mounted relative to said housing, said retraction armature pivotally connected to said armature shroud intermediate said shroud first and second ends.

18. The door security system of claim 17, wherein said electrical retraction assembly includes:

an elongated trim slide with a first end including a shoulder orthogonal to said housing longitudinal axis and an opposing second end, said pivot cam pivotally engageable with said shoulder, said trim slide slidingly displaceable along said housing longitudinal axis; and a trim pivot with intersecting first and second arms, said first arm engaging said trim slide second end and said second arm pivotally connected to said lift link, said trim pivot pivotally mounted to said housing at the intersection of said trim pivot arms.

19. The door security system of claim 18, including:

a rotatable trim cam with a pair of wings engageable against said trim slide for retracting said latch bolt upon application of a rotating force in either a clockwise or counterclockwise direction;

wherein said electrical retraction assembly is responsive to either said remote control system or said rotating force to retract said latch bolt to said retracted position.

20. The door security system of claim 14, wherein:

said housing defines a plurality of slots; and said manual retraction assembly includes, an elongated push pad with a proximate end adjacent said latch assembly and a distal end spaced from said latch assembly, said push pad substantially linearly displaceable between said outward position and said inward position, a spaced pair of links each having an outward end pivotally connected to said push pad and an inward end simultaneously pivotally and slidingly engageable with said housing slots, one said link inward end biased along said housing longitudinal axis away from said latch assembly, a bar pivotally connected to each said link inward end;

wherein displacement of one said push pad end results in linear displacement of both said push pad ends toward said inward position.

* * * * *